US006789481B2

(12) United States Patent
Verschueren et al.

(10) Patent No.: US 6,789,481 B2
(45) Date of Patent: Sep. 14, 2004

(54) ON-PRESS COATING AND ON-PRESS PROCESSING OF A LITHOGRAPHIC MATERIAL

(75) Inventors: Eric Verschueren, Merksplas (BE); Joseph Vander Aa, Rijmenam (BE); Joan Vermeersch, Deinze (BE); Rudi Goedeweeck, Rotselaar (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/068,312

(22) Filed: Feb. 5, 2002

(65) Prior Publication Data

US 2002/0112630 A1 Aug. 22, 2002

Related U.S. Application Data

(60) Provisional application No. 60/274,265, filed on Mar. 8, 2001.

(30) Foreign Application Priority Data

Feb. 16, 2001 (EP) ..... 01000018

(51) Int. Cl.[7] ..... B41C 1/10; B41M 1/06

(52) U.S. Cl. ..... 101/467; 101/452

(58) Field of Search ..... 101/450.1, 451, 101/452, 457, 462, 465, 466, 467, 415.1; 430/302, 309

(56) References Cited

U.S. PATENT DOCUMENTS

| | | | | | |
|---|---|---|---|---|---|
| 4,147,549 | A | * | 4/1979 | Held | 101/453 |
| 5,786,128 | A | * | 7/1998 | Vermeersch et al. | 430/302 |
| 5,816,162 | A | | 10/1998 | Vermeersch | |
| 5,996,499 | A | * | 12/1999 | Gelbart et al. | 101/467 |
| 6,030,750 | A | | 2/2000 | Vermeersch et al. | |
| 6,040,115 | A | * | 3/2000 | Bailey et al. | 101/467 |
| 6,095,048 | A | | 8/2000 | Ellis | |
| 6,140,392 | A | * | 10/2000 | Kingman et al. | 523/160 |
| 6,387,595 | B1 | * | 5/2002 | Teng | 430/302 |
| 6,391,516 | B1 | | 5/2002 | Vermeersch et al. | |
| 6,482,571 | B1 | * | 11/2002 | Teng | 430/302 |
| 6,548,222 | B2 | | 4/2003 | Teng | |
| 2002/0072013 | A1 | | 6/2002 | Vander Aa | |
| 2002/0112629 | A1 | | 8/2002 | Vander Aa et al. | |

FOREIGN PATENT DOCUMENTS

| | | |
|---|---|---|
| EP | 0 640 478 A1 | 3/1995 |
| EP | 0 770 494 A2 | 5/1997 |
| EP | 0 771 645 | 5/1997 |
| EP | 0 774 364 A1 | 5/1997 |
| FR | 1 561 957 | 4/1969 |
| FR | 2 287 715 | 5/1976 |
| WO | WO 00/32705 A1 | 6/2000 |

* cited by examiner

*Primary Examiner*—Stephen R. Funk
(74) *Attorney, Agent, or Firm*—Leydig, Voit & Mayer, Ltd.

(57) ABSTRACT

A method of lithographic printing is disclosed which comprises the steps of unwinding a web of a flexible lithographic base from a supply spool, the lithographic base having a hydrophilic surface, wrapping the lithographic base around a cylinder of a printing press, applying on the lithographic base an image-recording layer which is removable in a single-fluid ink or can be rendered removable in a single-fluid ink by exposure to heat or light, image-wise exposing the image-recording layer to heat or light, processing the image-recording layer by supplying single-fluid ink, thereby obtaining a printing master, printing by supplying single-fluid ink to the printing master which is mounted on a plate cylinder of the printing press; and removing the printing master from the plate cylinder, preferably by winding up on an uptake spool. Since the image-recording layer can be processed by single-fluid ink, the imaging material is suitable for on-press processing in printing presses wherein no fountain solution is supplied to the plate. The method allows a rapid, fully automatic plate change with reduced press down time.

12 Claims, No Drawings

ON-PRESS COATING AND ON-PRESS PROCESSING OF A LITHOGRAPHIC MATERIAL

CROSS-REFERENCE TO RELATED PATENT APPLICATIONS

This patent application claims priority to Patent Application No. 01000018.0, filed in Europe on Feb. 16, 2001, which is incorporated by reference. This application further claims the benefit of Provisional Application No. 60/274,265 filed Mar. 8, 2001, which is incorporated by reference.

FIELD OF THE INVENTION

The present invention relates to a method of lithographic printing wherein a lithographic base is unrolled from a supply roll, wrapped around a cylinder of a printing press, and on-press coated with an image-recording layer, which is then image-wise exposed and processed by supplying single-fluid ink.

BACKGROUND OF THE INVENTION

Lithographic printing presses use a so-called printing master such as a printing plate which is mounted on a cylinder of the printing press. The master carries a lithographic image on its surface and a print is obtained by applying ink to said image and then transferring the ink from the master onto a receiver material, which is typically paper. In conventional lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called driographic printing, the lithographic image consists of ink-accepting and ink-abhesive (ink-repelling) areas and during driographic printing, only ink is supplied to the master.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate (CTP) method has gained a lot of interest. This method, also called direct-to-plate method, bypasses the creation of film because the digital document is transferred directly to a plate precursor by means of a so-called plate-setter. A special type of CTP processes involves the exposure of a plate precursor while being mounted on a plate cylinder of a printing press by means of an image-setter that is integrated in the press. This method may be called 'computer-to-press' and printing presses with an integrated plate-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. EP-A 640 478 describes a digital press with an automatic plate-loading system comprising a supply roll and an uptake roll within the plate cylinder.

Typical plate materials used in computer-to-press methods are based on ablation. A problem associated with ablative plates is the generation of debris which is difficult to remove and may disturb the printing process or may contaminate the exposure optics of the integrated image-setter. Other methods require wet processing with chemicals which may damage or contaminate the electronics and optics of the integrated image-setter and other devices of the press. Therefore, lithographic coatings which require no wet processing or may be processed with plain water, ink or fountain is especially desired in computer-to-press methods. WO 90002044, WO 91008108 and EP-A 580 394 disclose such plates, which are, however, all ablative plates having a multi-layer structure which makes them less suitable for on-press coating. U.S. Pat. No. 6,095,048 discloses the processing of an ablation-type material with a single-fluid ink.

A non-ablative plate which can be processed with fountain and ink is described in EP-B 770 494. The latter patent specification discloses a method wherein an imaging material comprising an image-recording layer of a hydrophilic binder, a compound capable of converting light to heat and hydrophobic thermoplastic polymer particles, is image-wise exposed, thereby converting the exposed areas into a hydrophobic phase that define the printing areas of the printing master. The press run can be started immediately after exposure without any additional treatment because the layer is processed by interaction with the fountain and ink that are supplied to the cylinder during the press run. Therefore, the wet chemical processing of these materials is 'hidden' to the user and accomplished during the first runs of the printing press.

A problem associated with the latter method is that the on-press processing is done by the steps of first supplying fountain to the plate and subsequently also ink, which can easily be carried out in printing presses wherein the ink and fountain rollers can be engaged independently from one another. However, it is more difficult to optimize on-press processing by the simultaneous application of fountain and ink, which is the only option in printing presses that are equipped with an integrated ink/fountain supply.

In addition, processing of plate materials by fountain is not possible in a driographic press since only ink is supplied to the plate in such presses. Driographic presses need careful temperature control because there is no cooling effect from an aqueous fountain liquid.

So there is need for a method wherein on-press processing of an imaging material can be achieved without the supply of aqueous fountain liquid.

Whereas a plate precursor normally consists of a sheet-like support and one or more functional coatings, computer-to-press methods have been described, e.g. in GB1546532, wherein a composition, which is capable to form a lithographic surface upon image-wise exposure and optional processing, is provided directly on the surface of a plate cylinder of the press. EP-A 101 266 describes the coating of a hydrophobic layer directly on the hydrophilic surface of a plate cylinder. After removal of the non-printing areas by ablation, a master is obtained. However, ablation should be avoided in computer-to-press methods, as discussed above. U.S. Pat. No. 5,713,287 describes a computer-to-press method wherein a so-called switchable polymer such as tetrahydro-pyranyl methylmethacrylate is applied directly on the surface of a plate cylinder. The switchable polymer is converted from a first water-sensitive property to an opposite water-sensitive property by image-wise exposure.

A problem associated with the known on-press coating methods is that, after printing, the coating needs to be removed from the plate cylinder so that a next cycle of on-press coating, exposure, processing and printing can be started. During the time period necessary for this cleaning step, the printing press is not productive. Press down time should be minimized.

BRIEF SUMMARY OF THE INVENTION

It is an object of the present invention to provide an on-press coating, on-press exposure, and on-press processing method that is applicable in all lithographic printing presses, also those that contain no fountain supply. It is a further object to minimize the press down time. These objects are realized by the method of claim 1.

It has been found that excellent results can be obtained by using a single-fluid ink for the on-press processing of an imaging material comprising an image-recording layer which is soluble in such a single-fluid ink or can be rendered soluble in the single-fluid ink by the exposure step. Single-fluid ink is generally understood as an emulsion of an ink phase in a polar phase, or vice-versa, an emulsion of a polar phase in an ink phase. Single-fluid ink allows printing with a conventional, wet lithographic printing master without the application of a dampening liquid. The ink phase adsorbs onto the hydrophobic areas of the printing master and the polar phase wets the hydrophilic areas, thereby preventing adsorption of the ink component on the non-printing portions of the lithographic image.

The lithographic coating is not applied on the plate cylinder itself but on a flexible lithographic base which is automatically supplied from a spool and then wrapped around a press cylinder. After on-press coating, on-press exposure, on-press processing and printing, no cleaning step is carried out for removing the coating from the base. Instead, the printing master is removed from the plate cylinder, and a fresh lithographic base can be loaded on the cylinder to start a next cycle of on-press coating, on-press exposure, on-press processing and printing. This cycle can be repeated several times, the exact number being dependent on the length of the web of the lithographic base that is present on the supply spool. Preferably the number of print cycles is larger than 1, more preferably larger than 10 and most preferably larger than 30. Since plate changing and loading is fully automatic, the press down time between print cycles is minimized.

Further objects of the present invention will become apparent from the detailed description. Specific features for preferred embodiments of the invention are set out in the dependent claims.

DETAILED DESCRIPTION OF THE INVENTION

The imaging material used in the present invention comprises a flexible lithographic base and an image-recording layer.

The lithographic base comprises a support in web form which is sufficiently flexible so that it can be wound on a spool. The support has a hydrophilic surface or is provided with a hydrophilic layer. The flexible support may consist of paper, plastic, a thin metal such as aluminum, or a composite or a laminate thereof, e.g. a laminate of plastic and metal. A highly preferred example is a PET film laminated to aluminum which Is sufficiently thin to allow winding on a spool. Preferred examples of plastic film are polyethylene terephthalate (PET) film, polyethylene napbthalate film, cellulose acetate film, polystyrene film, polycarbonate film, etc. The plastic film support may be opaque or transparent.

A particularly preferred lithographic base having a hydrophilic surface is an electrochemically grained and anodized aluminum support. The anodized aluminum support may be treated to improve the hydrophilic properties of its surface. For example, the aluminum support may be silicated by treating its surface with a sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulfonic acid, polyvinylbenzenesulfonic acid, sulfuric acid esters of polyvinyl alcohol, and acetals of polyvinyl alcohols formed by reaction with a sulfonated aliphatic aldehyde It is further evident that one or more of these post treatments may be carried out alone or in combination. More detailed descriptions of these treatments are given in GB-A-1 084 070, DE-A-4 423 140, DE-A-4 417 907, EP-A-659 909, EP-A-537 633, DE-A-4 001 466, EP-A-292 801, EP-A-291 760 and U.S. Pat. No. 4,458,005.

A support which has no hydrophilic surface may be provided with a hydrophilic layer, called base layer. The base layer is preferably a cross-linked hydrophilic layer obtained from a hydrophilic binder cross-linked with a hardening agent such as formaldehyde, glyoxal, polyisocyanate or a hydrolyzed tetra-alkylorthosilicate. The latter is particularly preferred. The thickness of the hydrophilic base layer may vary in the range of 0.2 to 25 $\mu$m and is preferably 1 to 10 $\mu$m.

The hydrophilic binder for use in the base layer is e.g. a hydrophilic (co)polymer such as homopolymers and copolymers of vinyl alcohol, acrylamide, methylol acrylamide, methylol methacrylamide, acrylate acid, methacrylate acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60% by weight, preferably 80% by weight.

The amount of hardening agent, in particular tetraalkyl orthosilicate, is preferably at least 0.2 parts per part by weight of hydrophilic binder, more preferably between 0.5 and 5 parts by weight, most preferably between 1 parts and 3 parts by weight.

The hydrophilic base layer may also contain substances that increase the mechanical strength and the porosity of the layer. For this purpose colloidal silica may be used. The colloidal silica employed may be in the form of any commercially available water dispersion of colloidal silica for example having an average particle size up to 40 nm, e.g. 20 nm. In addition inert particles of larger size than the colloidal silica may be added e.g. silica prepared according to Stober as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the hydrophilic base layer is given a uniform rough texture consisting of microscopic hills and valleys, which serve as storage places for water in background areas.

Particular examples of suitable hydrophilic base layers for use in accordance with the present invention are disclosed in EP-A-601 240, GB-P-1 419 512, FR-P-2 300 354, U.S. Pat. Nos. 3,971,660, and 4,284,705.

It is particularly preferred to use a film support to which an adhesion improving layer, also called subbing layer, has been provided. Particularly suitable adhesion improving layers for use in accordance with the present invention comprise a hydrophilic binder and colloidal silica as disclosed in EP-A- 619 524, EP-A- 620 502 and EP-A-619 525. Preferably, the amount of silica in the adhesion improving layer is between 200 mg/m$^2$ and 750 mg/m$^2$. Further, the ratio of silica to hydrophilic binder is preferably more than 1 and the surface area of the colloidal silica is preferably at least 300 m$^2$/gram, more preferably at least 500 m$^2$/gram.

The imaging material comprises at least one image-recording layer provided on the lithographic base. Preferably, only a single layer is provided on the base. The material may be light- or heat-sensitive, the latter being preferred because of daylight-stability. The image-recording layer of the material used in the present invention is preferably non-ablative. The term "non-ablative" shall be understood as meaning that the image-recording layer is not substantially removed during the exposure step. The material can be positive-working, i.e. the exposed areas of the image-recording layer are rendered removable with the single-fluid ink, thereby revealing the hydrophilic surface of the lithographic base which defines the non-printing areas of the master, whereas the non-exposed areas are not removable with the single-fluid ink and define the hydrophobic, printing areas of the master. In a more preferred embodiment, the material is negative-working, i.e. the unexposed areas of the image-recording layer are removable with the single-fluid ink, thereby revealing the hydrophilic surface of the lithographic base which defines the non-printing areas of the master, whereas the exposed areas are not removable with the single-fluid ink and define the hydrophobic, printing areas of the master. The term removable indicates that the image-recording layer can be removed from the lithographic base by the supply of single-fluid ink, e.g. by dissolution of the layer in the single-fluid ink or by the formation of a dispersion or emulsion of the layer in the single-fluid ink.

In a preferred embodiment, the imaging material is negative-working and comprises an image-recording layer that is removable with the single-fluid ink before exposure and is rendered less removable upon exposure. Two highly preferred embodiments of such a negative-working image-recording layer will now be discussed.

In a first highly preferred embodiment, the working mechanism of the imaging layer relies on the heat-induced coalescence of hydrophobic thermoplastic polymer particles, preferably dispersed in a hydrophilic binder, as described in e.g. EP 770 494; EP 770 495; EP 770 497; EP 773 112; EP 774 364; and EP 849 090. The coalesced polymer particles define a hydrophobic, printing area that is not readily removable with the single-fluid ink whereas the unexposed layer defines a non-printing area that is readily removable with the single-fluid ink. The thermal coalescence can be induced by direct exposure to heat, e.g. by means of a thermal head, or by the light absorption of one or more compounds that are capable of converting light, more preferably infrared light, into heat. Particularly useful light-to-heat converting compounds are for example dyes, pigments, carbon black, metal carbides, borides, nitrides, carbonitrides, bronze-structured oxides, and conductive polymer dispersions such as polypyrrole, polyaniline or polythiophene-based conductive polymer dispersions. Infrared dyes and carbon black are highly preferred.

The hydrophobic thermoplastic polymer particles preferably have a coagulation temperature above 35° C. and more preferably above 50° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition of the polymer particles. Preferably, the coagulation temperature is at least 10° C. below the temperature at which the decomposition of the polymer particles occurs. Specific examples of hydrophobic polymer particles are e.g. polyethylene, polyvinyl chloride, polymethyl (meth)acrylate, polyethyl (meth) acrylate, polyvinylidene chloride, polyacrylonitrile, polyvinyl carbazole, polystyrene or copolymers thereof. Most preferably used is polystyrene. The weight average molecular weight of the polymers may range from 5,000 to 1,000,000 g/mol. The hydrophobic particles may have a particle size from 0.01 $\mu$m to 50 $\mu$m, more preferably between 0.05 $\mu$m and 10 $\mu$m and most preferably between 0.05 $\mu$m and 2 $\mu$m. The amount of hydrophobic thermoplastic polymer particles contained in the image forming layer is preferably between 20% by weight and 65% by weight and more preferably between 25% by weight and 55% by weight and most preferably between 30% by weight and 45% by weight.

Suitable hydrophilic binders are for example synthetic homo- or copolymers such as a polyvinylalcohol, a poly (meth)acrylic acid, a poly(meth)acrylamide, a polyhydroxyethyl(meth)acrylate, a polyvinylmethylether or natural binders such as gelatin, a polysacharide such as e.g. dextran, pullulan, cellulose, arabic gum, alginic acid.

In the second highly preferred embodiment, the imaging layer comprises an aryldiazosulfonate homo- or copolymer that is hydrophilic and soluble in the single-fluid ink before exposure and rendered hydrophobic and less soluble after such exposure. The exposure can be done by the same means as discussed above in connection with thermal coalescence of polymer particles. Alternatively, the aryldiazosulfonate polymer can also be switched by exposure to UV light, e.g. by a UV laser or a UV lamp.

Preferred examples of such aryldiazosulfonate polymers are the compounds which can be prepared by homo- or copolymerization of aryldiazosulfonate monomers with other aryldiazosulfonate monomers and/or with vinyl monomers such as (meth)acrylic acid or esters thereof, (meth) acrylamide, acrylonitile, vinylacetate, vinylchloride, vinylidene chloride, styrene, $\alpha$-methyl styrene etc. Suitable aryldiazosulfonate polymers for use in the present invention have the following formula:

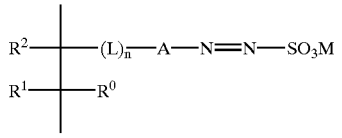

wherein $R^{0,1,2}$ each independently represent hydrogen, an alkyl group, a nitrile or a halogen, e.g. Cl, L represents a divalent linking group, n represents 0 or 1, A represents an aryl group and M represents a cation. L preferably represents divalent linking group selected from the group consisting of —$X_t$—$CONR^3$—, —$X_t$—COO—, —X— and —$X_t$—CO—, wherein t represents 0 or 1, $R^3$ represents hydrogen, an alkyl group or an aryl group, X represents an alkylene group, an arylene group, an alkylenoxy group, an arylenoxy group, an alkylenethio group, an arylenethio group, an alkylenamino group, an arylenamino group, oxygen, sulfur or an aminogroup. A preferably represents an unsubstituted aryl group, e.g. an unsubstituted phenyl group or an aryl group, e.g. phenyl, substituted with one or more alkyl group, aryl group, alkoxy group, aryloxy group or amino group. M preferably represents a cation such as $NH_4^+$ or a metal ion such as a cation of Al, Cu, Zn, an alkaline earth metal or alkali metal.

Suitable aryldiazosulfonate monomers for preparing the above polymers are disclosed in EP-A 339393, EP-A 507008 and EP-A 771645. Specific examples are:

M1

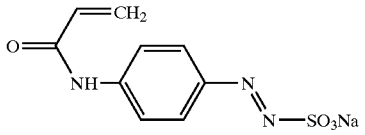

M2

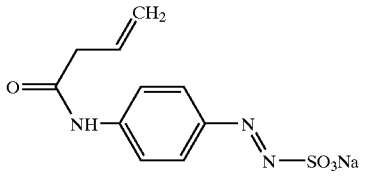

M3

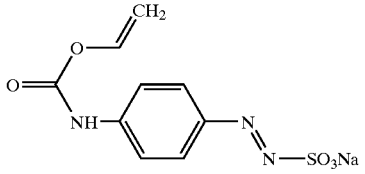

M4

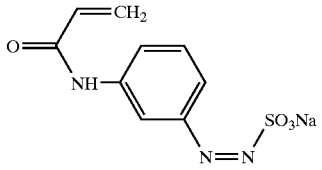

M5

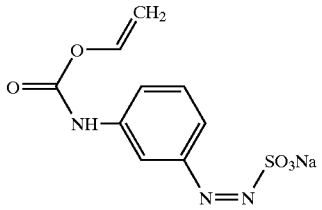

M6

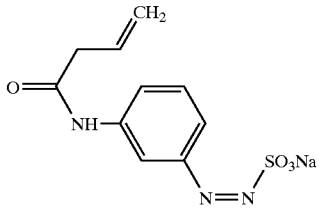

-continued

M7

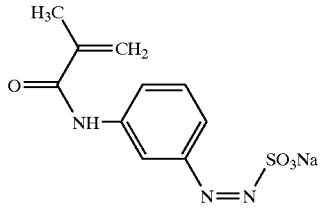

M8

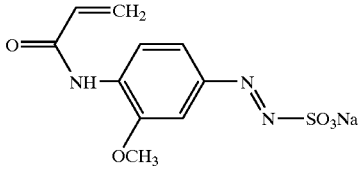

M9

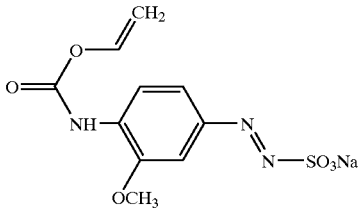

M10

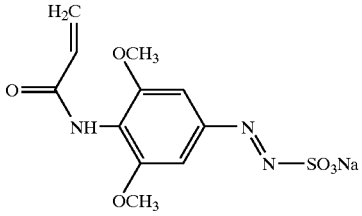

M11

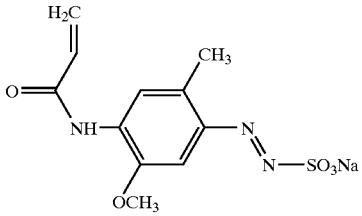

M12

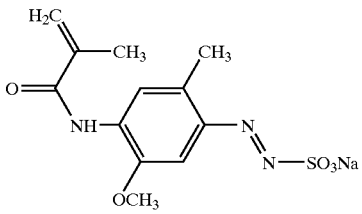

-continued

M13

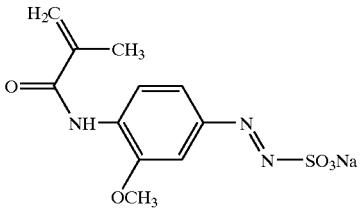

M14

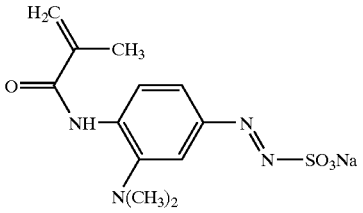

M15

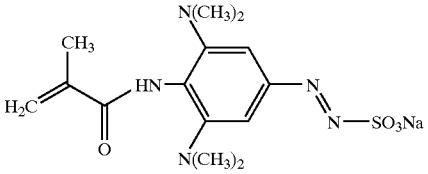

M16

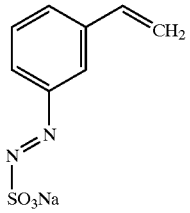

M17

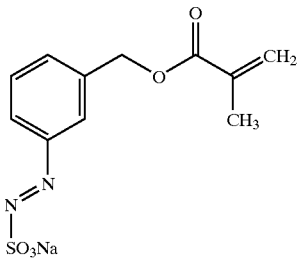

M18

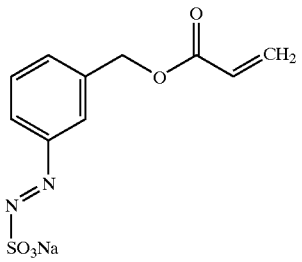

M19

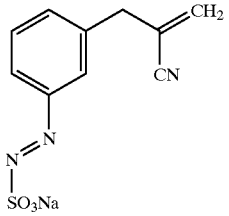

-continued

M20

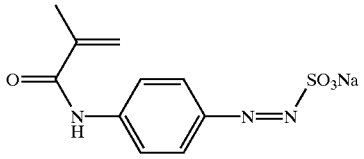

The imaging material may also comprise other layers, in addition to the image-recording layer. Such other layers are preferably provided on the lithographic base which is stored on the supply spool, so that only the image-recording layer is coated on-press. A preferred example is a light absorbing layer which contains a light absorbing compound, e.g. a compound which converts light into heat. The image-recording layer, which comprises e.g. the hydrophobic thermoplastic polymer particles or the aryldiazosulfonate polymer described above, is applied on top of that light absorbing layer during the on-press coating step.

Single-fluid inks which are suitable for use in the method of the present invention have been described in U.S. Pat. Nos. 4,045,232, 4,981,517 and U.S. Pat. No. 6,140,392. Single-fluid ink is generally understood as an emulsion of an ink phase in a polar phase, or vice-versa, an emulsion of a polar phase in an ink phase. The ink phase is also called the hydrophobic or oleophilic phase. The polar phase preferably comprises at least 50%, more preferably at least 70% and even more preferably at least 90% of a non-aqueous, polar liquid. In a most preferred embodiment, the polar phase consists of an organic, polar liquid and comprises essentially no water. The polar liquid is preferably a polyol. A highly preferred single-fluid ink has been described in WO 00/32705, of which the relevant content is reproduced hereinafter.

The hydrophobic phase preferably comprises a vinyl resin having carboxyl functionality. The term "vinyl resin" includes polymers prepared by chain reaction polymerization, or addition polymerization, through carbon-carbon double bonds, using vinyl monomers and monomers copolymerizable with vinyl monomers. Typical vinyl monomers include, without limitation, vinyl esters, acrylic and methacrylic monomers, and vinyl aromatic monomers including styrene. The vinyl polymers may be branched by including in the polymerization reaction monomers that have two reaction sites. When the vinyl polymer is branched, it nonetheless remains usefully soluble. By "soluble" it is meant that the polymer can be diluted with one or more solvents. (By contrast, polymers may be crosslinked into insoluble, three-dimensional network structures that are only be swelled by solvents.) The branched vinyl resins retain solvent dilutability in spite of significant branching.

The carboxyl-functional vinyl polymers may be prepared by polymerization of a monomer mixture that includes at least one acid-functional monomer or at least one monomer that has a group that is converted to an acid group following polymerization, such as an anhydride group. Examples of acid-functional or anhydride-functional monomers include, without limitation, α,β-ethylenically unsaturated monocarboxylic acids containing 3 to 5 carbon atoms such as acrylic, methacrylic, and crotonic acids; α,β-ethylenically unsaturated dicarboxylic acids containing 4 to 6 carbon atoms and the anhydrides and monoesters those acids, such as maleic anhydride, and fumaric acid; and acid-functional derivatives of copolymerizable monomers, such as the hydroxylethyl acrylate half-ester of succinic acid.

It is preferred to include an acid-functional monomer such as acrylic acid, methacrylic acid, or crotonic acid, or an anhydride monomer such as maleic anhydride or itaconic anhydride that may be hydrated after polymerization to generate acid groups. It is preferred for the acid-functional vinyl polymer to have an acid number of at least about 3 mg KOH per gram nonvolatile, preferably an acid number of from about 6 to about 30 mg KOH per gram nonvolatile, and more preferably an acid number of from about 8 to about 25 mg KOH per gram nonvolatile, based upon the nonvolatile weight of the vinyl polymer.

In a preferred embodiment, the acid-functional polymers are significantly branched. The inks used in the present invention preferably include a vinyl polymer that is branched but usefully soluble. The branched vinyl polymers may be diluted, rather than swollen, by addition of solvent. The branching may be accomplished by at least two methods. In a first method, a monomer with two or more polymerizable double bonds is included in the polymerization reaction. In a second method, a pair of ethylenically unsaturated monomers, each of which has in addition to the polymerizable double bond at least one additional functionality reactive with the additional functionality on the other monomer, are included in the monomer mixture being polymerized. Preferably, the reaction of the additional functional groups takes place during the polymerization reaction, although this is not seen as critical and the reaction of the additional functional groups may be carried out partially or wholly before or after polymerization. A variety of such pairs of mutually reactive groups are possible. Illustrative examples of such pairs of reactive groups include, without limitation, epoxide and carboxyl groups, amine and carboxyl groups, epoxide and amine groups, epoxide and anhydride groups, amine and anhydride groups, hydroxyl and carboxyl or anhydride groups, amine and acid chloride groups, alkylene-imine and carboxyl groups, organoalkoxysilane and carboxyl groups, isocyanate and hydroxyl groups, cyclic carbonate and amine groups, isocyanate and amine groups, and so on. When carboxyl or anhydride groups are included as one of the reactive groups, they are used in a sufficient excess to provide the required carboxyl functionality in the vinyl resin. Specific examples of such monomers include, without limitation, glycidyl (meth)acrylate with (meth) acrylic acid, N-alkoxymethylated acrylamides (which react with themselves) such as N-isobutoxymethylated acrylamide, gamma-methacryloxytrialkoxysilane (which reacts with itself), and combinations thereof.

Preferably, the vinyl resin is polymerized using at least one monomer having two or more polymerizable ethylenically unsaturated bonds, and particularly preferably from two to about four polymerizable ethylenically unsaturated bonds. Illustrative examples of monomers having two or more ethylenically unsaturated moieties include, without limitation, (meth)acrylate esters of polyols such as 1,4-butanediol di(meth)acrylate, 1.6-hexanediol di(meth) acrylate, neopentyl glycol di(meth)acrylate, trimethylol propane tri(meth)acrylate, tetramethylol methane tetra(meth) acrylate, pentaerythritol tetra(meth)acrylate, dipentaerythritol penta(meth)acrylate, dipentaerythritol hexa(meth)acrylate, alkylene glycol di(meth)acrylates and polyalkylene glycol di(meth)acrylates, such as ethylene glycol di(meth)acrylate, butylene glycol di(meth)acrylate, diethylene glycol di(meth)acrylate, triethylene glycol di(meth)acrylate, and polyethylene glycol di(meth)acrylate; divinylbenzene, allyl methacrylate, diallyl phthalate, diallyl terephthalate, and the like, singly or in combinations of two or more. Of these, divinylbenzene, butylene glycol dimethacrylate, butanediol dimethacrylate, trimethylolpropane triacrylate, and pentaerythritol tetra-acrylate are highly preferred, and divinylbenzene is still more highly preferred.

Preferably, the branched vinyl polymer is polymerized using at least about 0.008 equivalents per 100 grams of monomer polymerized of at least one monomer having at least two ethylenically unsaturated polymerizable bonds, or 0.004 equivalents per 100 grams of monomer polymerized of each of two monomers having mutually reactive groups in addition to an ethylenically unsaturated polymerizable bond. Preferably, the branched vinyl polymer is polymerized using from about 0.012 to about 0.08 equivalents, and more preferably from about 0.016 to about 0.064 equivalents per 100 grams of monomer polymerized of the polyfunctional monomer or monomers having at least two ethylenically unsaturated polymerizable bonds or of the pair of monomers having one polymerization bond and one additional mutually reactive group.

The polyfunctional monomer or monomers preferably have from two to four ethylenically unsaturated polymerizable bonds, and more preferably two ethylenically unsaturated polymerizable bonds. In one embodiment it is preferred for the branched vinyl resin to be prepared by polymerizing a mixture of monomers that includes from about 0.5% to about 6%, more preferably from about 1.2% to about 6%, yet more preferably from about 1.2% to about 4%, and even more preferably from about 1.5% to about 3.25% divinylbenzene based on the total weight of the monomers polymerized. (Commercial grades of divinylbenzene include mono-functional and/or non-functional material. The amount of the commercial material needed to provide the indicated percentages must be calculated. For example, 5% by weight of a material that is 80% by weight divinylbenzene/20% mono-functional monomers would provide 4% by weight of the divinylbenzene fraction).

The optimum amount of (1) divinylbenzene or other monomer having at least two polymerizable ethylenically unsaturated bond or (2) pair of monomers having polymerizable group and additional, mutually-reactive groups that are included in the polymerization mixture depends to some extent upon the particular reaction conditions, such as the rate of addition of monomers during polymerization, the solvency of the polymer being formed in the reaction medium chosen, the amount of monomers relative to the reaction medium, the half-life of the initiator chosen at the reaction temperature and the amount of initiator by weight of the monomers, and may be determined by straightforward testing.

Other monomers that may be polymerized along with the polyfunctional monomers and the acid-functional monomers (or monomers with groups that can later be converted to acid groups) include, without limitation, esters of α,β-ethylenically unsaturated monocarboxylic acids containing 3 to 5 carbon atoms such as esters of acrylic, methacrylic, and crotonic acids; α,β-ethylenically unsaturated dicarboxylic acids containing 4 to 6 carbon atoms and the anhydrides, monoesters, and diesters of those acids; vinyl esters, vinyl ethers, vinyl ketones, and aromatic or heterocyclic aliphatic vinyl compounds. Representative examples of suitable esters of acrylic, methacrylic, and crotonic acids include, without limitation, those esters from reaction with saturated aliphatic and cycloaliphatic alcohols containing 1 to 20 carbon atoms, such as methyl, ethyl, propyl, isopropyl, n-butyl, isobutyl, tert-butyl, 2-ethylhexyl, lauryl, stearyl, cyclohexyl, trimethylcyclohexyl, tetrahydrofurfuryl, stearyl, sulfoethyl, and isobornyl acrylates, methacrylates, and crotonates; and polyalkylene glycol acrylates and methacrylates. Representative examples of other ethylenically unsaturated polymerizable monomers include, without limitation, such compounds as fumaric, maleic, and itaconic anhydrides, monoesters, and diesters with alcohols such as methanol, ethanol, propanol, isopropanol, butanol, isobutanol, and tert-butanol. Representative examples of polymerization vinyl monomers include, without limitation, such compounds as vinyl acetate, vinyl propionate, vinyl ethers such as vinyl ethyl ether, vinyl and vinylidene halides, and vinyl ethyl ketone. Representative examples of aromatic or heterocyclic aliphatic vinyl compounds include, without limitation, such compounds as styrene, α-methyl styrene, vinyl toluene, tert-butyl styrene, and 2-vinyl pyrrolidone. The selection of monomers is made on the basis of various factors commonly considered in making ink varnishes, including the desired glass transition temperature and the desired dilutability of the resulting polymer in the solvent or solvent system of the ink composition.

The preferred vinyl polymers may be prepared by using conventional techniques, preferably free radical polymerization in a semi-batch process. For instance, the monomers, initiator(s), and any chain transfer agent may be fed at a controlled rate into a suitable heated reactor charged with solvent in a semi-batch process. Typical free radical sources are organic peroxides, including dialkyl peroxides, such as di-tert-butyl peroxide and dicumyl peroxide, peroxyesters, such as tert-butyl peroxy 2-ethylhexanoate and tert-butyl peroxy pivalate; peroxy carbonates and peroxydicarbonates, such as tert-butyl peroxy isopropyl carbonate, di-2-ethylhexyl peroxydicarbonate and dicyclohexyl peroxydicarbonate; diacyl peroxides, such as dibenzoyl peroxide and dilauroyl peroxide; hydroperoxides, such as cumene hydroperoxide and tert-butyl hydroperoxide; ketone peroxides, such as cyclohexanone peroxide and methylisobutyl ketone peroxide; and peroxyketals, such as 1,1-bis(tert-butyl peroxy)-3,5,5-trimethylcyclohexane and 1,1-bis(ter-t-butyl peroxy)cyclohexane; as well as azo compounds such as 2,2'-azobis(2-methylbutanenitrile), 2,2'-azobis(2-methyl) propionitrile, and 1,1'-azobis(cyclohexanecarbonitrile). Organic peroxides are preferred. Particularly preferred is tert-butyl peroxy isopropyl carbonate. Chain transfer agents may also be used in the polymerization. Typical chain transfer agents are mercaptans such as octyl mercaptan, n- or tert-dodecyl mercaptan, thiosalicylic acid, mercaptocarboxylic acids such as mercaptoacetic acid and mercaptopropionic acid and their esters, and mercaptoethanol; halogenated compounds; and dimeric α-methyl styrene. Preferably, no chain transfer agent is included because of odor and other known drawbacks. The particular initiator and amount of initiator used depends upon factors known to the person skilled in the art, such as the reaction temperature, the amount and type of solvent (in the case of a solution polymerization), the half-life of the initiator, and so on.

The addition polymerization is usually carried out in solution at temperatures from about 20° C. to about 300° C, preferably from about 150° C. to about 200° C., more preferably from about 160° C. to about 165° C. Preferably, the polymerization is carried out with approximately the same reaction temperature and using the same initiator(s) throughout. The initiator should be chosen so its half-life at the reaction temperature is preferably no more than about thirty minutes, particularly preferably no more than about five minutes, and yet more preferably no more than about two minutes. Particularly preferred are initiators having a half-life of less than about one minute at a temperature of from about 150° C. to about 200° C. In general, more of the branching monomer can be included when the initiator half-life is shorter and/or when more initiator is used. The vinyl polymer vehicles used in the ink preferably have little or no residual (unreacted) monomer content. In particular, the vinyl vehicles are preferably substantially free of residual monomer, i.e., have less than about 0.5% residual monomer, and even more preferably less than about 0.1% residual monomer by weight, based on the total weight of the monomers being polymerized.

In a semi-batch process, the monomer and initiator is added to the polymerization reactor over a period of time, preferably at a constant rate. Typically, the add times are from about 1 to about 10 hours, and add times of from about three to about five hours are common. Longer add times typically produce lower number average molecular weights. Lower number average molecular weights may also be produced by increasing the ratio of solvent to monomer or by using a stronger solvent for the resulting polymer.

In general, the branched vinyl polymer used in the ink has a low number average molecular weight and a broad polydispersity. The number average molecular weight and weight average molecular weight of a vinyl resin used in the ink can be determined by gel permeation chromatography using polystyrene standards, which are available for up to 6 million weight average molecular weight, according to well-accepted methods. Polydispersity is defined as the ratio of $M_w/M_n$. In a preferred embodiment, the vinyl polymer has a number average molecular weight ($M_n$) of at least about 1000, and more preferably at least about 2000. The number average molecular weight is also preferably less than about 15,000, more preferably less than about 10,000, and even more preferably less than about 8500. A preferred range for $M_n$ is from about 1000 to about 10,000, a more preferred range for $M_n$ is from about 2000 to about 8500, and an even more preferred range is from about 4000 to about 8000. The weight average molecular weight should be at least about 30,000, preferably at least about 100,000. The weight average molecular weight ($M_w$) is preferably up to about 60 million, based upon a GPC determination using an available standard having 6 million weight average molecular weight. A preferred range for $M_w$ is from about 30,000 to about 55 million, a more preferred range for $M_w$ is from about 100,000 to about 1 million, and a still more preferred range is from about 100,000 to about 300,000. Resins having ultra-high molecular weight shoulders (above about 45 million), which can be seen by GPC, are preferably avoided for the $M_w$ range of from about 100,000 to about 300,000. The polydispersity, or ratio of $M_w/M_n$, may be up to about 10,000, preferably up to about 1000. The polydispersity is preferably at least about 15, particularly preferably at least about 50. The polydispersity preferably falls in the range of from about 15 to about 1000, and more preferably it falls in a range of from about 50 to about 800.

The theoretical glass transition temperature can be adjusted according to methods well-known in the art through selection and apportionment of the commoners. In a preferred embodiment, the theoretical $T_g$ is above room temperature, and preferably the theoretical $T_g$ is at least about 60° C., more preferably at least about 70° C. The methods and compositions of the present invention preferably employ vinyl polymers having a $T_g$ of from about 50° C. to about 125° C., more preferably from about 60° C. to about 100° C., and even more preferably from about 70° C. to about 90° C.

In one embodiment of the single-fluid ink, the acid-functional vinyl polymer, which may be a branched vinyl polymer, is combined with other resins in the ink composition. Examples of suitable other resins that may be combined with the acid-functional vinyl polymer include, without limitation, polyester and alkyd resins, phenolic resins, rosins, cellulosics, and derivatives of these such as rosin-modified phenolics, phenolic-modified rosins, hydrocarbon-modified rosins, maleic modified rosin, fumaric modified rosins; hydrocarbon resins, other acrylic or vinyl resins, polyamide resins, and so on. Such resins or polymers may be included in amounts of up to about 6 parts by weight to about 1 part by weight of the acid-functional vinyl polymer, based upon the nonvolatile weights of the resins.

In addition to the acid-functional vinyl resin and any optional second resin, the ink compositions preferably include one or more solvents. In a preferred embodiment of the single-fluid ink, the branched vinyl resin forms a solution or apparent solution having no apparent turbidity in the solvent or solvents of the ink formulation. The particular solvents and amount of solvent included is determined by the ink viscosity, body, and tack desired. In general, non-oxygenated solvents or solvents with low Kauri-butanol (KB) values are used for inks that will be in contact with rubber parts such as rubber rollers during the lithographic process, to avoid affecting the rubber. Suitable solvents for inks that will contact rubber parts include, without limitation, aliphatic hydrocarbons such as petroleum distillate fractions and normal and iso paraffinic solvents with limited aromatic character. For example, petroleum middle distillate fractions such as those available under the tradename Magie Sol, available from Magie Bros. Oil Company, a subsidiary of Pennsylvania Refining Company, Franklin Park, Ill., under the tradename ExxPrint, available from Exxon Chemical Co., Houston, Tex., and from Golden Bear Oil Specialties, Oildale, Calif., Total Petroleum Inc., Denver, Colo., and Calumet Lubricants Co., Indianapolis, Ind. may be used. In addition or alternatively, soybean oil or other vegetable oils may be included.

When non-oxygenated solvents such as these are used, it is generally necessary to include a sufficient amount of at least one monomer having a substantial affinity for aliphatic solvents in order to obtain the desired solvency of the preferred branched vinyl polymer. In general, acrylic ester monomers having at least six carbons in the alcohol portion of the ester or styrene or alkylated styrene, such as tert-butyl styrene, may be included in the polymerized monomers for this purpose. In a preferred embodiment, an ink composition with non-oxygenated solvents includes a branched vinyl resin polymerized from a monomer mixture including at least about 20%, preferably from about 20% to about 40%, and more preferably from about 20% to about 25% of a monomer that promotes aliphatic solubility such as stearyl methacrylate or t-butyl styrene, with stearyl methacrylate being a preferred such monomer. It is also preferred to include at least about 55% percent styrene, preferably from about 55% to about 80% styrene, and more preferably from about 60% to about 70% styrene. Methyl methacrylate or other monomers may also be used to reduce solvent tolerance in aliphatic solvent, if desired. All percentages are by weight, based upon the total weight of the monomer mixture polymerized. Among preferred monomer compositions for vinyl polymers for lithographic inks are those including a (meth)acrylic ester of an alcohol having 8–20 carbon atoms such as stearyl methacrylate, styrene, divinylbenzene, and (meth)acrylic acid. In a preferred embodiment, a branched vinyl for a lithographic printing ink is made with from about 15, preferably about 20, to about 30, preferably about 25, weight percent of a (meth)acrylic ester of an alcohol having 8–20 carbon atoms, especially stearyl methacrylate; from about 50, preferably about 60, to about 80, preferably about 75, weight percent of a styrenic monomer, especially styrene itself, an amount of divinylbenzene as indicated above; and from about 0.5, preferably about 2.5, to about 5, preferably about 4, weight percent of acrylic acid or, more preferably, of methacrylic acid.

Preferably, the solvent or solvent mixture will have a boiling point of at least about 100° C. and preferably not more than about 550° C. Offset printing inks may use solvents with boiling point above about 200° C. News inks usually are formulated with from about 20 to about 85 percent by weight of solvents such as mineral oils, vegetable oils, and high boiling petroleum distillates. The amount of solvent also varies according to the type of ink composition (that is, whether the ink is for newsprint, heatset, sheetfed, etc.), the specific solvents used, and other factors known in the art. Typically the solvent content for lithographic inks is up to about 60%, which may include oils as part of the solvent package. Usually, at least about 35% solvent is present in lithographic ink. When used to formulate the preferred single-fluid ink compositions, these varnishes or vehicles, including the branched vinyl resins, are typically clear, apparent solutions.

The ink compositions will usually include one or more pigments. The number and kinds of pigments will depend upon the kind of ink being formulated. News ink compositions typically will include only one or only a few pigments, such as carbon black, while gravure inks may include a more complicated pigment package and may be formulated in many colors, including colors with special effects such as pearlescence or metallic effect. Lithographic printing inks are typically used in four colors—magenta, yellow, black, and cyan, and may be formulated for pearlescence or metallic effect. Any of the customary inorganic and organic pigments may be used in the ink compositions of the present invention. Alternatively, the compositions may be used as overprint lacquers or varnishes. The overprint lacquers (air drying) or varnishes (curing) are intended to be clear or transparent and thus opaque pigments are not included.

Lithographic ink compositions used in the invention are preferably formulated as single-fluid inks having an oil-based continuous phase that contains the acid-functional vinyl vehicle and a polyol discontinuous phase that contains a liquid polyol. The vinyl polymer phase is relatively stable toward the polyol phase. The stability is such that the two phases do not separate in the fountain. During application of the ink, however, the emulsion breaks and the polyol comes to the surface, wetting out the areas of the plate that are not to receive ink. Inks that are stable in the fountain but break quickly to separate on the plate print cleanly without toning and provide consistent transfer characteristics. Proper stability also may depend upon the particular acid-functional vinyl polymer and the particular polyol chosen. The acid number and molecular weight may be adjusted to provide the desired stability.

Higher acid number vinyl resins can be used in lower amounts, but the acid number cannot be excessively high or else the vinyl polymer will not be sufficiently soluble in the hydrocarbon solvent. In general, it is believed that an increase in acid number of the acid-functional vinyl resin should be accompanied by a decrease in the amount of such resin included in the hydrophobic phase.

Polyethylene glycol oligomers such as diethylene glycol, triethylene glycol, and tetraethylene glycol, as well as ethylene glycol, propylene glycol, and dipropylene glycol, are examples of liquid polyols that are preferred for the polyol phase of the single-fluid ink used in the invention. The polyol phase may, of course, include mixtures of different liquid polyols. In general, lower acid number vinyl or acrylic polymers are used with higher molecular weight polyols. The polyol phase may include further materials. A weak acid such as citric acid, tartaric acid, or tannic acid, or a weak base such as triethanolamine, may be included in an amount of from about 0.01 weight percent up to about 2 weight percent of the ink composition. Certain salts such as magnesium nitrate may be included in amounts of from about 0.01 weight percent to about 0.5 weight percent, preferably from about 0.08 to about 1.5 weight percent, based on the weight of the ink composition, to help protect the plate and extend the life of the plate. A wetting agent, such as polyvinylpyrolidone, may be added to aid in wetting of the plate. From about 0.5 weight percent to about 1.5 weight percent of the polyvinylpyrollidone is included, based on the weight of the ink composition.

Single-fluid inks may be formulated with from about 5% to about 50%, preferably from about 10% to about 35%, and particularly preferably from about 20% to about 30% of polyol phase by weight based on the total weight of the ink composition. Unless another means for cooling is provided, there is preferably a sufficient amount of polyol in the ink composition to keep the plate at a workably cool temperature. The amount of polyol phase necessary to achieve good toning and printing results depends upon the kind of plate being used and may be determined by straightforward testing. Up to about 4 or 5% by weight of water may be included in the polyol phase mixture to aid in dissolving or homogenizing the ingredients of the polyol phase.

It will be appreciated by the skilled artisan that other additives known in the art that may be included in the ink compositions used in the invention, so long as such additives do not significantly detract from the benefits of the present invention. Illustrative examples of these include, without limitation, pour point depressants, surfactants, wetting agents, waxes, emulsifying agents and dispersing agents, defoamers, antioxidants, UV absorbers, dryers (e.g., for formulations containing vegetable oils), flow agents and other rheology modifiers, gloss enhancers, and anti-settling agents. When included, additives are typically included in amounts of at least about 0.001% of the ink composition, and may be included in amount of about 7% by weight or more of the ink composition.

The lithographic base is automatically supplied to a cylinder of a printing press by unwinding the base from a supply spool or from a supply roll, i.e. a web of lithographic base rolled on said supply spool. The unwound lithographic base is wrapped around a press cylinder, which is preferably the plate cylinder that holds the printing master during printing. The supply roll is preferably located within the plate cylinder as described in EP-A 640 478. Alternatively, the supply roll can also be located outside the cylinder and then, the unwound lithographic base is wrapped around the cylinder and preferably automatically cut from the web on the supply roll. After printing, the used material is preferably wound on an uptake roll or spool, which preferably is also integrated in the cylinder. Technical details of a preferred embodiment of such an integrated supply and an uptake roll as well as of the associated driving mechanism and tension control mechanism can be found in EP-A 640 478.

The image-recording layer can be applied by heat- or friction-induced transfer from a donor material as described in EP 1 048 458, or by powder coating, e.g. as described in EP-A 974 455 and EP-A 99203682, filed on Nov. 3, 1999, or by coating a liquid solution according to any known coating method, e.g. spin-coating, dip coating, rod coating, blade coating, air knife coating, gravure coating, reverse roll coating, extrusion coating, slide coating and curtain coating. An overview of these coating techniques can be found in the book "Modem Coating and Drying Technology", Edward Cohen and Edgar B. Gutoff Editors, VCH publishers, Inc, New York, N.Y., 1992. It is also possible to apply the coating solution to the substrate by printing techniques, e.g. ink-jet printing, gravure printing, flexo printing, or offset printing. Jetting as described in EP-A 00202700, filed on Jul. 31, 2000, is highly preferred.

According to another highly preferred embodiment, a coating solution is sprayed on the substrate by means of a head comprising a spray nozzle. Preferred values of the spraying parameters have been defined in EP-A 99203064 and EP-A 99203065, both filed on Sep. 15, 1999. In a preferred configuration, the spray head translates along the lithographic base in the axial direction while the press cylinder is rotating in the angular direction.

Coating by spraying or jetting are the preferred techniques for applying an image-recording layer which comprises thermoplastic polymer particles or an aryldiazosulphonate polymer, as described above.

The imaging material used in the present invention is exposed on-press to heat or to light, i.e. while the material is mounted on a press cylinder, preferably the plate cylinder which holds the printing master during printing. Exposure can be done by e.g. a thermal head, LEDs or a laser head. Preferably, one or more lasers such as a He/Ne laser, an Ar lasers or a violet laser diode are used. Most preferably, the light used for the exposure is not visible light so that daylight-stable materials can be used, e.g. UV (laser) light or a laser emitting near infrared light having a wavelength in the range from about 700 to about 1500 nm is used, e.g. a semiconductor laser diode, a Nd:YAG or a Nd:YLF laser. The required laser power depends on the sensitivity of the image-recording layer, the pixel dwell time of the laser beam, which is determined by the spot diameter (typical value of modern plate-setters at $1/e^2$ of maximum intensity: 10–25 $\mu$m), the scan speed and the resolution of the exposure apparatus (i.e. the number of addressable pixels per unit of linear distance, often expressed in dots per inch or dpi; typical value: 1000–4000 dpi). More technical details of on-press exposure apparatuses are described in e.g. U.S. Pat. Nos. 5,174,205 and 5,163,368.

After exposure, the image-recording layer is processed by supplying single-fluid ink, preferably by means of the inking rollers of the press that supply ink to the plate cylinder. Preferably, the same single-fluid ink is used for the processing step and the subsequent printing step. In that embodiment, the steps of processing and printing are part of the same operation: after exposure, the printing process is started by feeding single-fluid ink to the material; after the first few revolutions of the print cylinder (typically less than 20, more preferably less than 10), the imaging layer is completely processed and subsequently, high-quality printed copies are obtained throughout the press run. As explained above, the areas of the image-recording layer, which are soluble in the single-fluid ink or which have been rendered soluble in the single-fluid ink by the exposure step, are removed during the processing step. Preferably, the removed components are transferred to the print paper.

The processing of the imaging material with single-fluid ink can be preceded by an optional step wherein the image-recording layer is first moistened or allowed to swell by the supply of water or an aqueous liquid, without thereby substantially removing the image-recording layer.

The following examples further illustrate the invention but, of course, should not be construed as in any way limiting its scope.

EXAMPLE 1

1. Preparation of a Vinyl Varnish

An amount of 44.19 parts by weight of Ketrul 220 (a petroleum middle distillate fraction available from Total Petroleum, Inc.) is charged to a glass reactor equipped with stirrer, nitrogen inlet, total reflux condenser, and monomer inlet. The solvent is heated to 160° C. with stirring under a blanket of nitrogen. A monomer mixture of 36.01 parts by weight styrene, 12.27 parts by weight stearyl methacrylate, 2.62 parts by weight divinylbenzene, 1.89 parts by weight methacrylic acid, and 2.79 parts by weight t-butyl peroxy isopropyl carbonate (75% solution in mineral spirits) is added to the reactor over a period of three hours. After the monomer addition is complete, 0.23 parts by weight of t-butyl peroxy isopropyl carbonate is added over a period of fifteen minutes. The temperature is held at 160° C. for an additional two hours to allow for complete conversion of the monomer to polymer.

The measured amount of non-volatile matter (NVM) is 55%. The percent conversion, measured as NVM divided by the percent of the total weight of monomers, is 100.1. The acid number on solution is 12.0 mg KOH per gram. The viscosity is 30 Stokes (bubble tube, 54.4° C.). The solvent tolerance is 230% and the NVM at cloud point is 16.7%.

2. Preparation of Single-Fluid Ink 58.0 grams of the following Mixture A is added to 142.0 grams of the following Mixture B with stirring. The ink composition is mixed for 20 minutes on a dispersator, maintaining a vortex and holding the temperature under 60° C. The ink composition has a single fall time Laray of 14 to 17 seconds for 500 grams at 30° C.

Mixture A: Mix in a glass beaker until clear 181.0 grams of diethylene glycol, 8.0 grams of water, 0.4 grams of citric acid, and 0.4 grams of magnesium nitrate. Add 191.2 grams of diethylene glycol and mix until homogenous.

Mixture B: Mix, using a high-speed mixer, 46.0 grams of the above Vinyl Varnish, 4.0 grams of Blue Flush 12-FH-320 (available from CDR Corporation, Elizabethtown, Ky.) 1.0 gram technical grade Soy oil (available from Cargill, Chicago, Ill.) and 0.6 grams of an antioxidant. While mixing, add 34.4 grams of a hydrocarbon resin solution (60% LX-2600 in EXX-Print 283D, available from Neville), 27.0 grams of a carbon black (CSX-156 available from Cabot Corp.), and 1.0 gram of a polytetrafluoroethylene wax (Pinnacle 9500D, available from Carrol Scientific). Mix at a high speed for 30 minutes at 149° C. Slow the mixing speed and add 27.0 grams of EXX-Print 588D (available from Exxon). Mill the premix in a shot mill to a suitable grind.

Mixture B has a Laray viscosity of 180 to 240 poise and a Laray yield of 800 to 1200 (according to test method ASTM D4040: Power Law-3 k, 1.5 k, 0.7 k, 0.3 k). Mixture B is tested on the Inkometer for one minute at 1200 rpm for a measured result of 25 to 29 units.

3. The Lithographic Base

A web of PET, having a thickness of 0.175 mm, was coated at a wet coating thickness of 50 $\mu$m with a layer from a 23.6% aqueous coating solution having a pH of 4. After cooling for 30 sec at 10° C., the layer was dried at a temperature of 50° C. with a moisture content of the air of 4 g/m$^3$ during at least 3 minutes. The resulting hydrophilic base layer contained 8990 mg/m$^2$ of $TiO_2$, 900 mg/m$^2$ of $SiO_2$, 990 mg/m$^2$ of polyvinylalcohol, 81.6 mg/m$^2$ of SAPONIN™, 36.8 mg/m$^2$ of HOSTAPON T™ and 605 mg/m$^2$ of FT248™.

SAPONIN is a nonionic surfactant mixture consisting of esters and polyglycosides, commercially available from Merck. HOSTAPON T is an anionic surfactant, commercially available from Hoechst AG. FT248 is an anionic perfluoro surfactant, commercially available from Bayer AG.

The above-mentioned $TiO_2$ and $SiO_2$ were added to the coating solution as a dispersion in the polyvinylalcohol. The $TiO_2$ dispersion had an average particle size of between 0.3 and 0.5 $\mu$m. The polyvinyl alcohol was hydrolyzed polyvinyl acetate, commercially available from Wacker Chemie GmbH, Germany under the trademark POLYVIOL WX™. The $SiO_2$ mentioned above was added as a dispersion of hydrolyzed tetramethyl orthosilicate.

4. The Image-recording Layer

A 2.61 wt. % solution in water was prepared by mixing a polystyrene latex, a heat absorbing compound and a hydrophilic binder. This solution was coated on the hydrophilic base layer of the above-described PET support. After drying, the image-recording layer had a thickness of 0.83 $\mu$m and contained 75 wt. % of the polystyrene latex, 10 wt. % of the infrared dye IR-1, and 15 wt. % of polyacrylic acid (Glascol E15 commercially available at N. V. Allied Colloids Belgium) as hydrophilic binder.

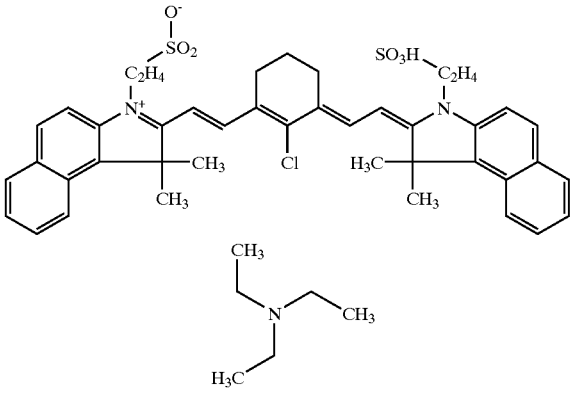

IR-1

The above solution was sprayed onto the lithographic base. Therefore, the lithographic base was mounted on a cylinder, rotating at a line speed of 164 m/min. The imaging element was coated by a spray nozzle moving in the axial direction of the cylinder at a speed of 1.5 m/min. The spray nozzle was mounted on a distance of 40 mm between nozzle and the base. The flow rate of the spray solution was set to 7 ml/min. During the spray process an air pressure of 90 psi was used on the spray head. The coating was dried at an air temperature of 70° C. during the spraying process.

The spray nozzle used was of the type SUV76, an air assisted spray nozzle, commercially available at Spraying Systems Belgium, Brussels.

5. Exposure, Processing and Printing

The above imaging material was exposed with an external drum platesetter (830 nm, at 2400 dpi, surface line speed of 1 m/s and power setting of 16 Watt), installed on the print cylinder of a modified KORD 64 printing press from Heidelberger Druckmaschinen, Germany. After exposure, the press was started and the above-described single-fluid ink was supplied to the image-recording layer. After 10 revolutions, the processing step was complete and the paper supply was started. Clear prints were obtained with no ink uptake in the non-image parts.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of lithographic printing comprising the steps of:

(i) unwinding a web of a flexible lithographic base from a supply spool, the lithographic base having a hydrophilic surface;

(ii) wrapping the lithographic base around a cylinder of a printing press;

(iii) applying on the lithographic base an image-recording layer comprising hydrophobic thermoplastic particles or an aryldiazosulfonate polymer which is removable in a single-fluid ink or can be rendered removable in a single-fluid ink by exposure to heat or light;

(iv) image-wise exposing the image-recording layer to heat or light;

(v) processing the image-recording layer by supplying single-fluid ink, thereby obtaining a printing master;

(vi) printing by supplying single-fluid ink to the printing master which is mounted on a plate cylinder of the printing press; and (vii) removing the printing master from the plate cylinder.

2. The method according to claim 1 wherein the image-recording layer is a non-ablative image-recording layer which is removable with the single-fluid ink before exposure to heat or light and is rendered less removable by exposure to heat or light.

3. The method according to claim 2 wherein step (vii) is carried out by winding the printing master on an uptake spool which is located within the plate cylinder.

4. The method according to claim 2 wherein the supply spool is located within the plate cylinder.

5. The method according to claim 4 wherein step (vii) is carried out by winding the printing master on an uptake spool which is located within the plate cylinder.

6. The method according to claim 1 wherein the image-recording layer further comprises a hydrophilic binder.

7. The method according to claim 1 wherein the supply spool is located within the plate cylinder.

8. The method according to claim 1 wherein step (vii) is carried out by winding the printing master on an uptake spool which is located within the plate cylinder.

9. The method according to claim 8 wherein the supply spool is located within the plate cylinder.

10. The method according to claim 1 wherein the flexible lithographic base comprises a plastic support, a thin aluminum support or a laminate of plastic and thin aluminum.

11. The method according to claim 1 wherein the single-fluid ink is an emulsion comprising:

(i) a continuous phase comprising an acid-functional vinyl resin; and (ii) a discontinuous phase comprising a liquid polyol.

12. The method according to claim 11 wherein the vinyl resin is a branched acid-functional vinyl resin having a number average molecular weight of between about 1000 and about 15000 and a weight average molecular weight of at least about 100000.

* * * * *